US006253823B1

(12) United States Patent
Swopes et al.

(10) Patent No.: US 6,253,823 B1
(45) Date of Patent: Jul. 3, 2001

(54) HEADRAIL FOR CUT DOWN VENETIAN TYPE BLINDS

(75) Inventors: Cletis F. Swopes, Madison, WI (US); Ludwig Nicholas Ross, Emsworth, PA (US); Ren Judkins, 46 Newgate Rd., Pittsburgh, PA (US) 15202

(73) Assignees: Springs Window Fashions Division, Inc., Middleton, WI (US); Ren Judkins, Pittsburgh, PA (US)

( * ) Notice: Subject to any disclaimer, the term of this patent is extended or adjusted under 35 U.S.C. 154(b) by 0 days.

(21) Appl. No.: 09/457,553

(22) Filed: Dec. 9, 1999

(51) Int. Cl.[7] ..... E06B 9/30

(52) U.S. Cl. ..... 160/168.1 R; 160/178.2 R; 160/176.1 R

(58) Field of Search ..... 160/176.1 R, 168.1 R, 160/177 R, 178.2 R

(56) References Cited

U.S. PATENT DOCUMENTS

| | | | | |
|---|---|---|---|---|
| 2,129,606 | * | 9/1938 | Nisenson | 160/178.2 R |
| 2,544,184 | * | 3/1951 | Rosenbaum | 160/177 R |
| 2,620,026 | * | 12/1952 | Rutledge | 160/177 R |
| 2,620,866 | * | 12/1952 | Rosenbaum | 160/177 R |
| 2,659,431 | * | 11/1953 | Nelson | 160/177 R |
| 2,667,220 | * | 1/1954 | Rutledge | 160/177 R |
| 2,670,038 | * | 2/1954 | Lorentzen | 160/177 R |
| 2,721,609 | * | 10/1955 | Rutledge | 160/177 R |
| 2,779,403 | * | 1/1957 | Lorentzen | 160/177 R |
| 3,425,479 | * | 2/1969 | Lorentzen et al. | 160/176.1 R |

* cited by examiner

*Primary Examiner*—Blair M. Johnson
(74) *Attorney, Agent, or Firm*—Buchanan Ingersoll, P.C.

(57) ABSTRACT

A venetian type blind has a headrail that can be cut down along cut lines very close to the outermost ladder locations. The cradle and spool in the headrail are sized and configured so that the cord lock and tilter can be positioned between a cradle and one side of the headrail.

23 Claims, 6 Drawing Sheets

HEADRAIL FOR CUT DOWN VENETIAN TYPE BLINDS

FIELD OF INVENTION

The invention relates to a venetian type blind and more particularly those venetian type blinds that are cut down to make the blind narrower in width by trimming off portions of the headrail, slats and bottomrail.

BACKGROUND OF THE INVENTION

Venetian type blinds have a series of slats hung on ladders that extend from a headrail to a bottomrail. In most venetian blinds a pair of lift cords is provided each having one end attached to the bottomrail and then passing through elongated holes in the slats up to and through the headrail. Alternatively, the lift cords may pass through slots in the edges of the slats as shown in U.S. Pat. No. 5,573,051. A cord lock is usually provided in the headrail through which the lift cords pass. The cord lock allows the user to maintain the blind in any desired position from fully raised to fully lowered.

The slats rest on rungs between rails of the ladders. In most venetian type blinds the upper end of each ladder is attached to a drum. There is one drum for each ladder and the drums are carried on an axle. The blind is in an open position when the rungs are horizontal. To close the blind one operates a tilt mechanism that turns the axle to rotate the drums. This raises one rail of each ladder while allowing the other to be lowered thereby tilting the slats. Tilt mechanisms can be a wand type or a cord type. A wand tilter has a gear drive between the wand and the axle. Wand tilters are usually attached through a gearbox to one end of the axle. The drum of a cord tilter can be anywhere on the axle, but is usually at one end.

The window covering industry has been offering lines of stock blinds that come in standard widths. These blinds are sold through home centers and other large retailers who sell home furnishings. Should the customer have windows that have a width different from the standard width the retailer can trim portions off the ends of the headrail, slats and bottomrail of a standard or stock blind to create a venetian blind that fits the window. The amount that can be removed from a blind is limited to the distance between the outermost ladder and the edge of the blind (usually 6" or 152 mm) less the space required for the cord lock or tilt mechanism and a portion of the drum and cradle. This space usually requires about 3" to 3 ½" (76 to 89 mm) depending if the lift cord and tilter are on the same side or opposite sides of the blind. Since the blinds are cut down to remove an equal amount from each side a total of 5" to 6" (127 to 152 mm) is the maximum that a blind can be cut down. Consequently, a larger number of stock widths must be maintained in inventory than would be needed if blinds could be trimmed at the locations closer to where the outermost ladders enter the headrail. For that reason there is a need for a headrail for venetian type blind and blinds containing a headrail that can be cut down very close to the outermost ladders.

SUMMARY OF THE INVENTION

We provide a headrail for venetian type blinds that contains a narrow width spool on a compact cradle at each ladder location. Each cradle has at least one and preferably a pair of uprights attached to the cradle base. The cradles support a tilt axle that carries a spool at each ladder location. The uprights are narrow and offset to the backside of the headrail and a height not greater than the height of the sides of the headrail to provide space for a cord lock or tilt mechanism to be mounted either fully or partially in front of the cradle. The spool is a narrow drum having opposite sides and a hub extending from each side. Each upright preferably abuts or supports a hub. A cord lock is positioned so that at least a portion of the cord lock is in front of the cradle. If a cord type tilter is used the fitting which passes the tilt cords from the headrail can be positioned to be at least partially in front of the another portion of the same cradle or be at least partially in front of a cradle on the opposite end of the headrail. This type of construction increases the amount that a blind can be cut down to nearly 10 ½" (267 mm) and reduces the required number of inventoried sizes by up to 45%.

Other objects and advantages of the present invention will become apparent from a description of the present preferred embodiments shown in the drawings.

DESCRIPTION OF THE PREFERRED EMBODIMENTS

Figure 2:
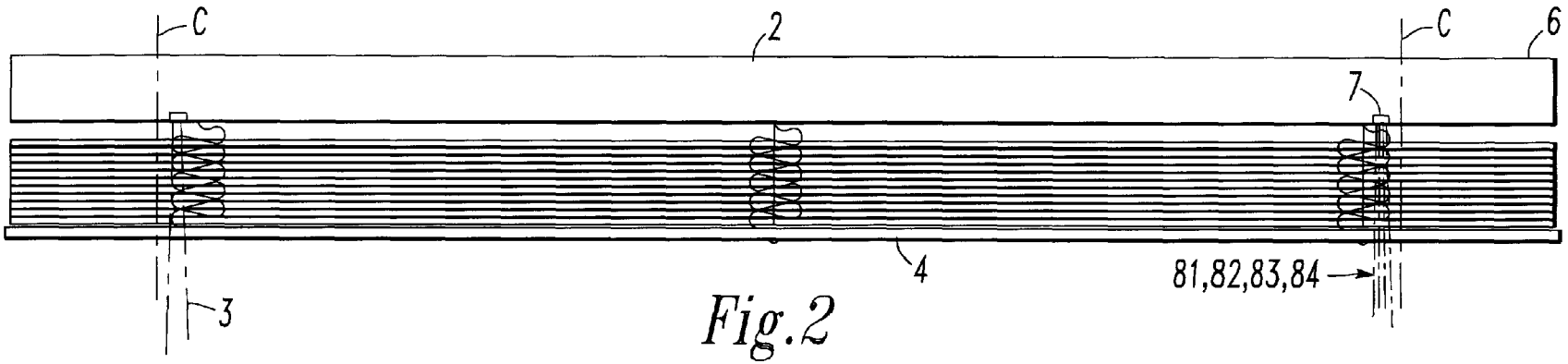
FIG. 2 is a front view similar to FIG. 1 showing the blind in a raised position.

A present preferred embodiment is comprised of a headrail 2, a bottomrail 4 and set of slats 5 extending there between. A one piece or two-piece bottomrail could be used. For purposes of illustration only six slats are shown. However, the blind could have any number of slats and likely would have many more slats than are shown. The slats are suspended on cord type ladders 10. Each ladder has a front rail, rear rail and series of rungs extending there between on which these slats rest. The bottom ends of the ladders are attached to the bottomrail 4. Lift cords pass from the bottomrail into and through the headrail. The lift cords may pass through holes in the slats or as in the embodiment shown in the drawings may pass through slots in the edges of the slats. At least two front slots are provided on the front edge of each slat 5. A corresponding set of rear slots have been cut into the back edge of the slats opposite the front slots. We prefer to have the slots directly opposite one another. However, one slot could be to the left or right of the other slot. The slots are sized so that lift cords 81, 82, 83 and 84, and ends of rungs can loosely fit therein. Tilt ladders 10 are positioned near the ends of the blind so that the rails are adjacent the lift cords. A third tilt ladder is provided at the center of the blind where no lift cords are needed. For purposes of illustration the lift cords 81, 82, 83, 84 are shown in chain line in some of the figures so as to distinguish them from the adjacent rails of the tilt ladders or other structures.

Figure 11:
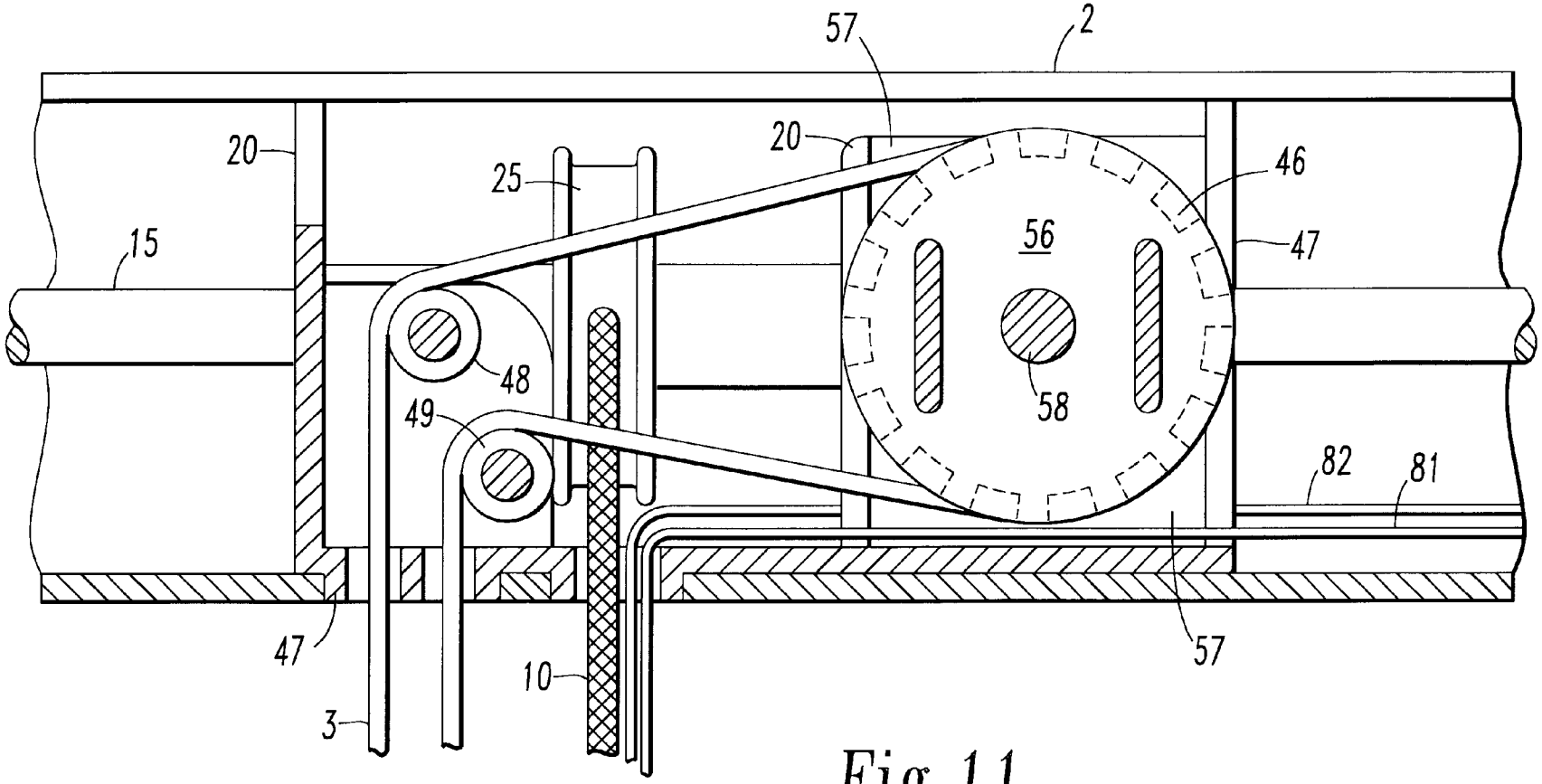
FIG. 11 is a sectional view similar to FIGS. 5, 7, 8 and 9 showing a tilt mechanism in front of the cradle.

The number of lift cords that are used will vary according to the size of the blind and the cording arrangement. In the cording arrangement used in the blind of FIGS. 1 and 2 lift cords are positioned near either end of the blind in slots on both the front and rear edges of the slats. The four lift cords 81, 82, 83, 84 extend from the bottomrail through the headrail and pass through cord lock 7 on the right side of the blind. In another cording arrangement cords would pass through slots in the front edge of the slats near the two outer ladders while a third lift cord would pass through a slot in the rear edge of each slat near the center ladder. A cord type tilt mechanism is provided at the left side of the blind in front of the cradle. The embodiment shown combines the tilt housing or fitting 47 with the cradle 20. This is preferred, but not necessary. This is shown more clearly in FIG. 11. A tilt cord 3 which may be a loop enters the headrail 2 through fitting 47. The headrail also carries pulleys 48 and 49 over which the tilt cord passes. The tilt cord 3 operates a sprocket 46 that is behind faceplate 56. The sprocket is connected via a typical worm gear arrangement to the tilt rod or axle 15. The sprocket is mounted on a post 58 that extends from a back wall 57 of housing 47 to a front wall of that housing. The front wall has been removed for the sectional view of FIG. 11. The axle 15 passes through a drum 25 within cradle 20. Pulling the tilt cord 3 will turn the sprocket 46, which causes the axle 15 to turn. As the axle turns, drum 25 also turns raising one rung of the ladder 10 attached to the drum and lowering the other rail of that ladder changing the tilt of the slats carried on the ladder.

Figure 1:
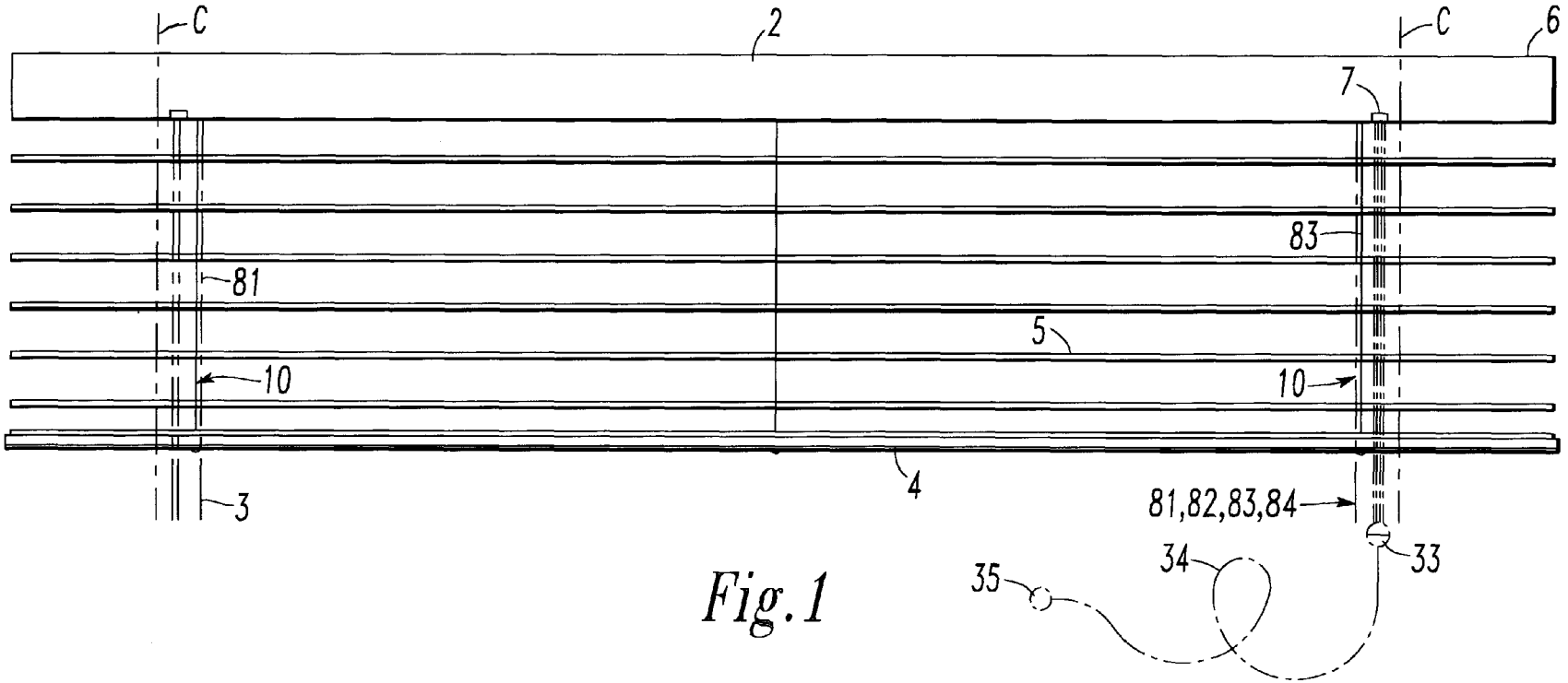
FIG. 1 is a front view of a venetian type blind shown in a lowered open positioned with cut down lines shown in chain lines.

Should a venetian blind of the type shown in FIGS. 1 and 2 be too wide for a window it will be necessary to trim portions of the blind from the ends. This can be done by cutting the headrail, slats and bottomrail along cut lines C. Since the tilt mechanism and cord lock are in front of the cradles, there is nothing in the outer ends of the headrail beyond the drums and cradles that support the ladders. Consequently, the headrail can be easily trimmed. If end caps are provided on the headrail one simply removes the end caps, cuts the headrail and replaces the end caps.

Figure 3:
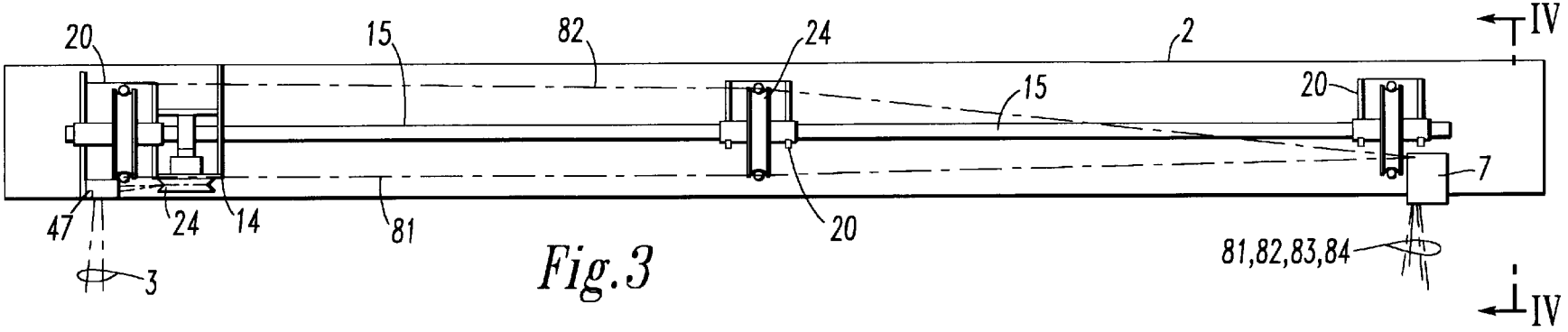
FIG. 3 is a top plan view of a present preferred embodiment of a headrail for venetian type blinds in accordance with the present invention.
Figure 4:
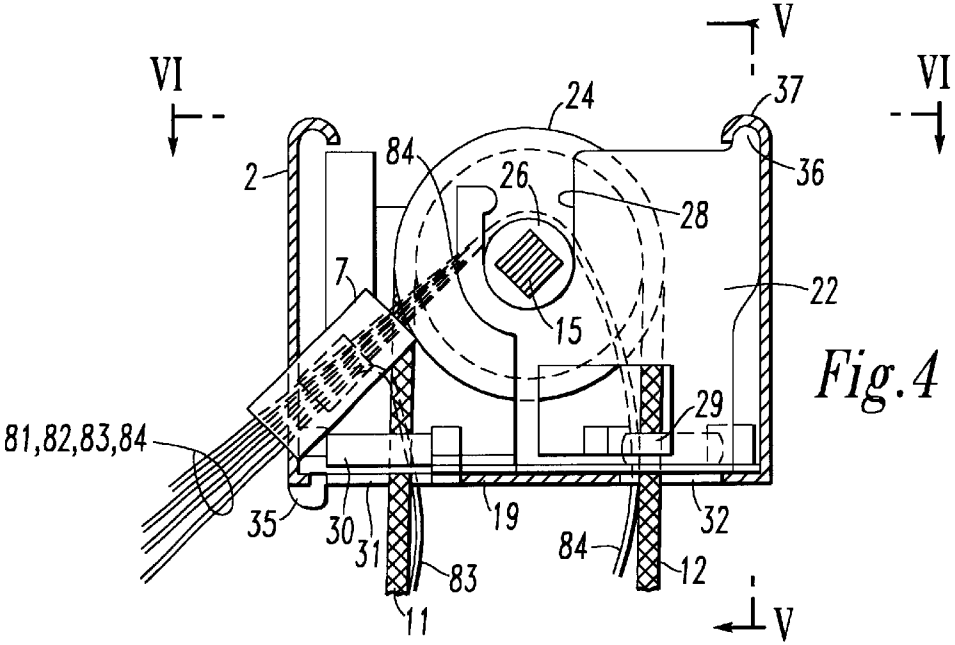
FIG. 4 is a sectional view taken along the line IV—IV of FIG. 3.
Figure 5:
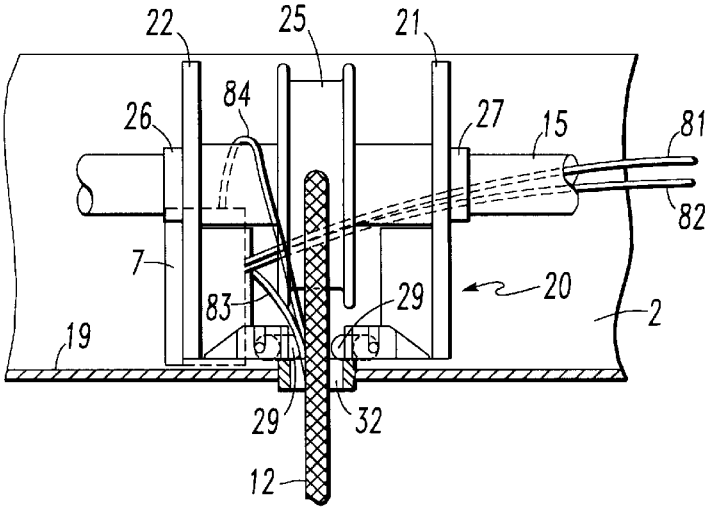
FIG. 5 is a sectional view along the line V—V of FIG. 4.
Figure 6:
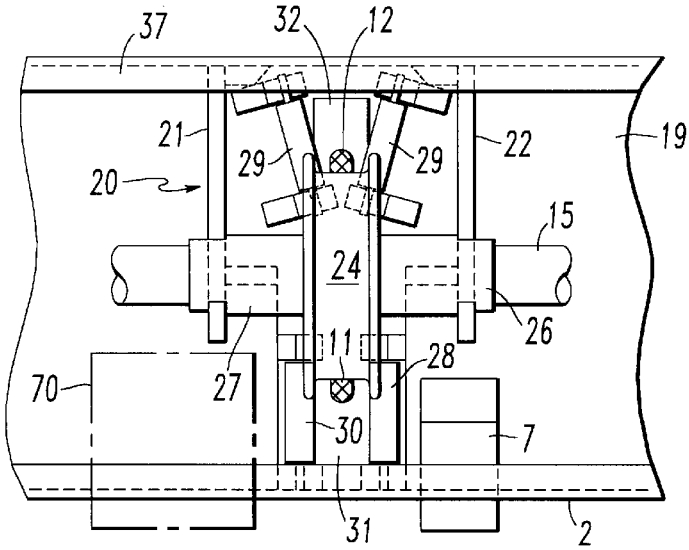
FIG. 6 is a top plan view of the cradle and spool shown in FIGS. 4 and 5 with the lift cords removed.
Figure 6A:
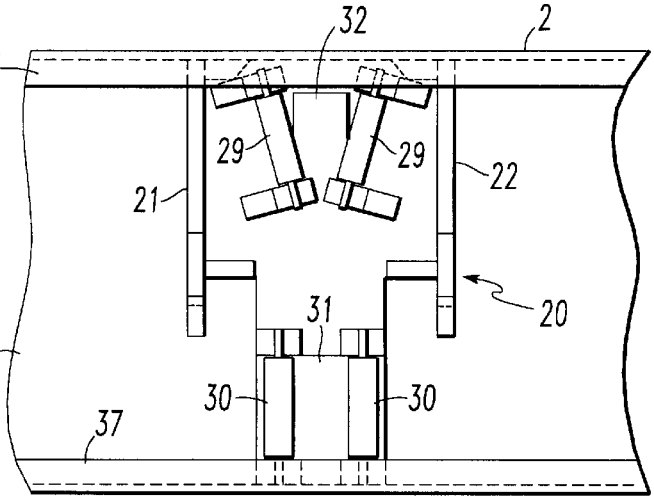
FIG. 6A is a top view similar to FIG. 6 with the spool and cord lock removed.

In a present preferred headrail shown in FIG. 3 the tilt mechanism 14 is provided adjacent the cradle 20 at the left of the headrail. The cord lock 7 is provided in front of the cradle 20 at the right most portion of the headrail. This can be done because the cradle is sized to have two uprights 21 and 22 that extend only about half way across the width of the headrail 2. A spool 24 is supported between the uprights 21 and 22. The spool has a narrow drum 25 and two hubs 26 and 27 that extend from opposite sides of the drum 25. The hubs are carried in slots 28 within the uprights. As shown most clearly in FIGS. 4, 5 and 6, cord lock 7 is placed in front of the cradle base 23. Optionally, the cord lock could be molded as an integral unit on the base 23 of the cradle to the right side of the drum 25 of spool 24. The front rail 11 and rear rail 12 of the cord ladder are attached to drum 25. Alternatively, the rails may be connected together and looped over the top of drum 25. Thus, turning of drum 20 will raise one rail of the ladder and lower the opposite rail to tilt the blind. Eyelets 31 and 32 extend from the base 23 of the cradle through the slot in the base 19 of the headrail. The cradle is held in place by tab 35 which extends from eyelet 31 under the front wall of the headrail and tab 36 which fits under the curved end 37 of the back wall of the headrail. The front lift cord 83 passes through eyelet 31, between rollers 30 and into cord lock 7. The rear lift cord 84 passes through eyelet 32, between rear rollers 29, over hub 26 and into cord lock 7. As shown in FIG. 3 the lift cords 81 and 82 from the opposite end of the blind are directed through the headrail and into cord lock 7. The cord lock 7 could be placed on the opposite side of the drum as indicated by chain line box 70 in FIG. 6. This position could also be the location of the housing 47 for a cord type tilter if one desired to have both the tilter and lift cords on the same side of the headrail. By positioning at least a portion of the cord lock and tilter directly in front of the cradle that holds the spool it is possible to cut down the blind along a line that is very close to the outer most ladders. As a consequence, any stock blind can now be used for windows as much as four inches narrower than could be used for blinds not having the cradle as shown and described here.

Although we prefer to use a cradle having two spaced apart parallel uprights one could use a cradle having a single upright. The cradle 40 shown in FIG. 7 has a base 41, upright 42 and top 43 and a sidewall 44. The base 41 and top 43 are in generally parallel planes and extend in opposite directions from opposite ends of the upright 43. The sidewall 44 is parallel to the upright 42. The cradle is oriented so that the base 41 extends toward the center of the blind. The tilt axle 15 extends through the upright 42 and sidewall 44 to a similar cradle (not shown) within the headrail that is spaced apart from the cradle 40. A similar spool 24 having a narrow drum 25 and at least one hub 26 is attached to the axle 15 near the cradle. Consequently, a lift cord could be routed over hub 26 between the drum 25 and the upright 42 to a cord lock 45 or over hub 27 between the drum 25 and sidewall 44 to the second cord lock 45'. The cord locks 45 and 45' are positioned so that at least a portion of each cord lock is in front of the cradle 40. This blind has eight lift cords. Four lift cords 81, 82, 83 and 84 pass through cord lock 45' and four lift cords 85, 86, 87 and 88 pass through cord lock 45. The locking mechanism in the cord locks are fitted relative to each other so that they operate simultaneously even though the angle of the cords coming into the lock varies significantly.

Figure 7:
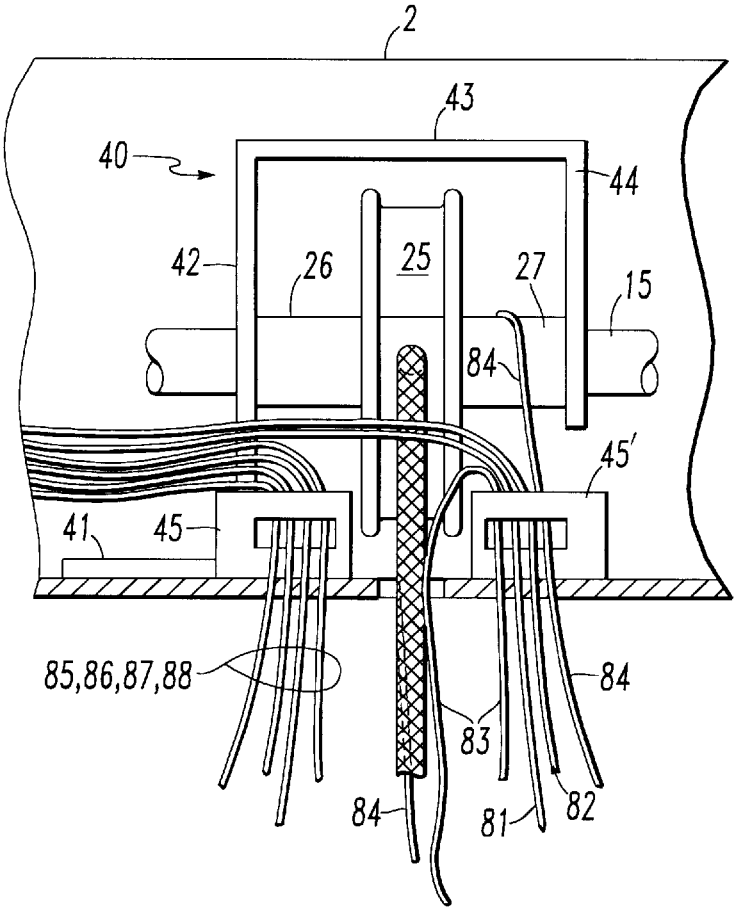
FIG. 7 is a sectional view similar to FIG. 5 showing a second preferred cradle.
Figure 8:
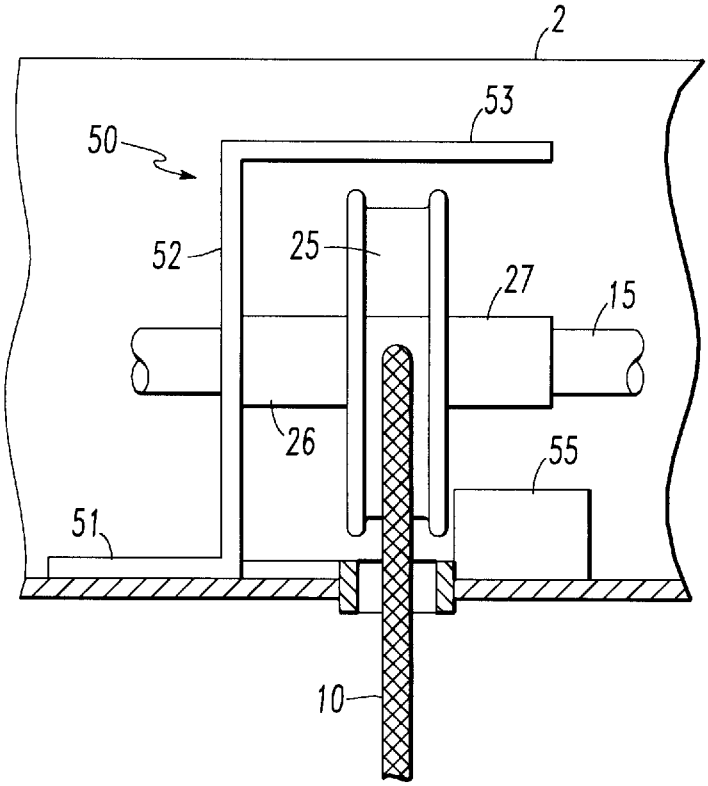
FIG. 8 is a sectional view similar to FIGS. 5 and 7 showing a third preferred cradle.

Another cradle similar to the cradle shown in FIG. 7 is illustrated in FIG. 8. This cradle 50 has a base 51, upright 52 and a top 53. A spool 24 having a narrow drum 25 and hubs 26 and 27 is carried on the tilt axle 15 adjacent the upright 52. The lift cords (not shown) could be routed from the back of the headrail over the tilt axle 15 or over hub 27 to a cord lock 55 that is at least partially in front of the cradle 50 and spool 24 combination. Ordinarily, the cradle surrounds the spool and the combination is often referred to as a cradle.

Figure 9:
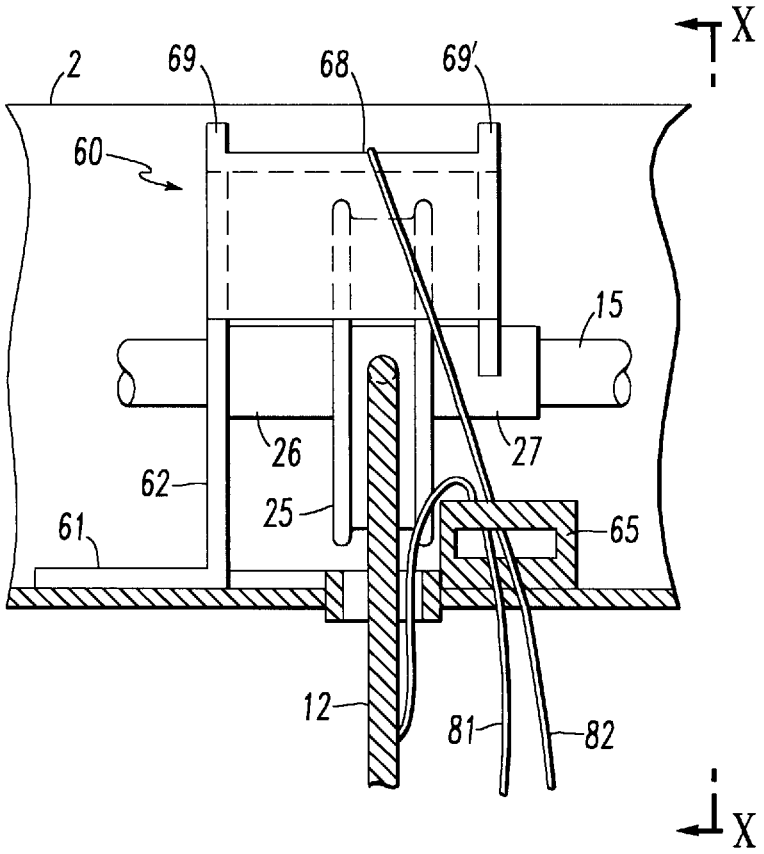
FIG. 9 is a sectional view similar to FIGS. 5, 7 and 8 showing a fourth preferred cradle.
Figure 10:
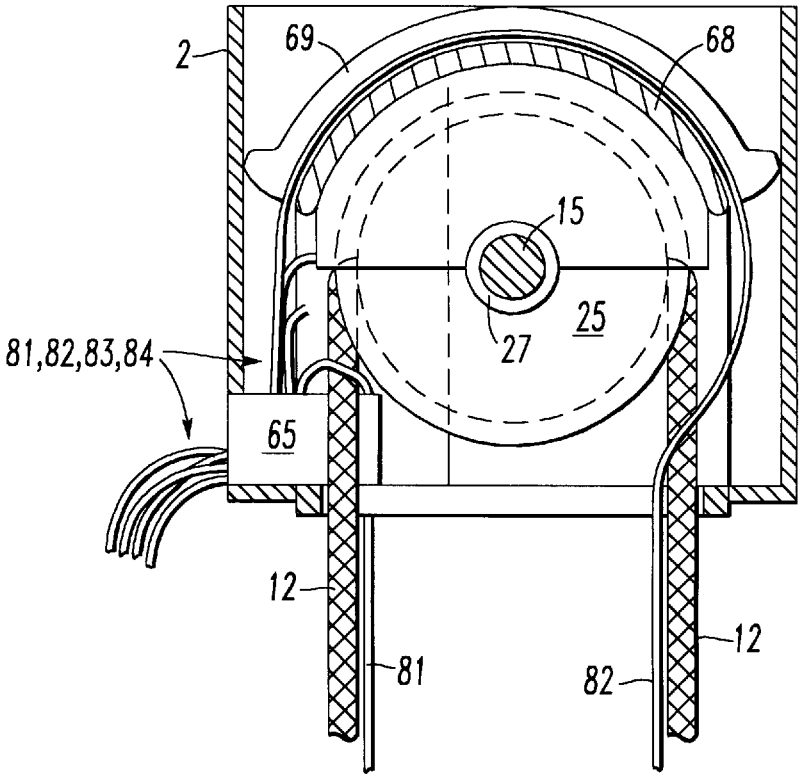
FIG. 10 is a sectional view taken along the line X—X of FIG. 9.

Another preferred cradle 60 shown in FIGS. 9 and 10 is similar to the cradle of FIG. 7, but has a cover 68 over the spool to permit lift cords to be routed over the cover 68 and into he lock 65. The cradle has a base 61, upright 62 and cover 68. The base 61 and cover 68 extend from the upright 62. The cover 68 is preferably semicircular to allow a lift cord 82 to easily ride over the cover as shown in FIG. 10. Side rails 69 and 69' are provided on the edges of the cover to prevent the lift cord from slipping off the cover. The side rail 69' in FIG. 10 is cutaway to better show the path of cord 82. Both side rails 69 and 69' extend to the headrail to prevent the lift cord 82 from slipping off during shipping and handling. This cradle is also configured to allow the cord lock 65 to be positioned at least partially in front of the cradle.

Although we have shown present preferred embodiments of our headrail and venetian blind it should be distinctly understood that the invention is not limited thereto, but may be variously embodied within the scope of the following claims.

We claim:

1. A headrail for a venetian type blind comprising:

a. an elongated body having a headrail base and a pair of spaced apart, generally parallel sides attached to the headrail base, the headrail base having a width and a plurality of openings through which lift cords and rails of a cord ladder can pass;

b. a cradle attached to the headrail base adjacent each opening, each cradle comprised of a cradle base and at least one upright attached to the cradle base;

c. a spool adjacent to each cradle, the spool comprised of a drum having opposite sides, such that there is an axis normal to the sides, one side of the drum being adjacent the at least one upright of the cradle so that the spool can rotate about the axis;

d. a tilt axle connected between the spools; wherein at least one of the cradles and the spool adjacent to that cradle are sized and configured to define a space in which a cord lock can be positioned to have at least a portion of the cord lock between one side of the headrail and at least one of the cradle and the spool; and e. a cord lock attached to the headrail such that at least a portion of the cord lock is within the space which is between the one side of the headrail and the at least one of the cradle and the spool along a line extending or thogonally to the one side of the headrail.

2. The headrail of claim 1 also comprising at least one roller attached to a cradle and positioned to guide at least one lift cord to the cord lock.

3. The headrail of claim 1 wherein the cradle is comprised of two parallel uprights.

4. The headrail of claim 1 also comprising a second cord lock within the headrail.

5. The headrail of claim 4 wherein at least a portion of the second cord lock is between one of the cradles and one side of the headrail.

6. The headrail of claim 1 also comprising a tilt mechanism connected to the tilt axle.

7. The headrail of claim 6 wherein the tilt mechanism is a wand type tilter.

8. The headrail of claim 6 wherein the tilt mechanism is a cord type tilter and at least a portion of the tilter is positioned such that at least a portion of the tilter is between a cradle and one side of the headrail.

9. The headrail of claim 1 also comprising a hub extending from one side of the drum.

10. The headrail of claim 9 wherein the hub is adjacent the at least one upright of the cradle.

11. A venetian blind comprised of a headrail, a bottomrail, a plurality of slats positioned on ladders extending from the bottomrail into the headrail and lift cords extending from the headrail to the bottomrail wherein the headrail comprises:

a. an elongated body having a headrail base and a pair of spaced apart, generally parallel sides attached to the headrail base, the headrail base having a width and a plurality of openings through which lift cords and rails of a cord ladder can pass;

b. a cradle attached to the headrail base adjacent each opening, each cradle comprised of a cradle base and at least one upright attached to the cradle base;

c. a spool adjacent to each cradle, the spool comprised of a drum having opposite sides, such that there is an axis normal to the sides, one side of the drum being adjacent the at least one upright of the cradle so that the spool can rotate about the axis;

d. a tilt axle connected between the spools; wherein at least one of the cradles and the spool adjacent to that cradle are sized and configured to define a space in which a cord lock can be positioned to have at least a portion of the cord lock between one side of the headrail and at least one of the cradle and the spool; and e. a cord lock attached to the headrail such that at least a portion of the cord lock is within the space which is between the one side of the headrail and the at least one of the cradle and the spool along a line extending or thogonally to the one side of the headrail.

12. The venetian blind of claim 11 also comprising at least one roller attached to the cradle and positioned to guide at least one lift cord to the cord lock.

13. The venetian blind of claim 11 wherein the cradle is comprised of two parallel uprights.

14. The venetian blind of claim 11 also comprising a second cord lock within the headrail.

15. The venetian blind of claim 4 wherein at least a portion of the second cord lock is between one of the cradles and one side of the headrail.

16. The venetian blind of claim 11 also comprising a tilt mechanism connected to the tilt axle.

17. The venetian blind of claim 16 wherein the tilt mechanism is a wand type tilter.

18. The venetian blind of claim 16 wherein the tilt mechanism is a cord type tilter and at least a portion of the tilter is positioned such that at least a portion of the tilter is between a cradle and one side of the headrail.

19. The venetian blind of claim 11 wherein the at least one upright has a portion that extends over the space in which a cord lock can be placed.

20. The venetian blind of claim 11 wherein at least one lift cord passes over the tilt axle.

21. A venetian blind comprised of a headrail, a bottomrail, a plurality of slats positioned on ladders extending from the bottomrail into the headrail and lift cords extending from the headrail to the bottomrail wherein the headrail comprises:

a. an elongated body having a headrail base and a pair of spaced apart, generally parallel sides attached to the headrail base, the headrail base having a width and a plurality of openings through which lift cords and rails of a cord ladder can pass;

b. a cradle attached to the headrail base adjacent each opening, each cradle comprised of a cradle base and at least one upright attached to the cradle base;

c. a spool adjacent to each cradle, the spool comprised of a drum having opposite sides, such that there is an axis normal to the sides, one side of the drum being adjacent the at least one upright of the cradle so that the spool can rotate about the axis;

d. a tilt axle connected between the spools; wherein at least one of the cradles and the spool adjacent to that cradle are sized and configured to define a space in which a cord lock can be positioned to have at least a portion of the cord lock between one side of the headrail and at least one of the cradle and the spool; and e. a cord lock and a cover, the cover attached to the cradle and positioned over the spool wherein at least one lift cord passes over the cover, and the cover is configured to direct the at least one lift cord to the cord lock.

22. The venetian blind of claim 11 also comprising a hub extending from one side of the drum.

23. The venetian blind of claim 22 wherein the hub is adjacent the at least one upright of the cradle.

* * * * *